US008001629B2

(12) United States Patent
Lang et al.

(10) Patent No.: US 8,001,629 B2
(45) Date of Patent: Aug. 23, 2011

(54) FLOOR DRAIN AND SANITARY INSTALLATION WITH SUCH A FLOOR DRAIN, AND METHOD OF FITTING SUCH A SANITARY INSTALLATION

(75) Inventors: Isabel Lang, Jona (CH); Franciscus Veron, Zürich (CH)

(73) Assignee: Geberit Technik AG, Jona (CH)

( * ) Notice: Subject to any disclaimer, the term of this patent is extended or adjusted under 35 U.S.C. 154(b) by 495 days.

(21) Appl. No.: 12/164,057

(22) Filed: Jun. 29, 2008

(65) Prior Publication Data

US 2009/0000025 A1 Jan. 1, 2009

(30) Foreign Application Priority Data

Jun. 29, 2007 (EP) ..... 07405184

(51) Int. Cl.
*E03C 1/12* (2006.01)

(52) U.S. Cl. ..... 4/679

(58) Field of Classification Search ..... 4/679–682, 4/88

See application file for complete search history.

(56) References Cited

U.S. PATENT DOCUMENTS

| | | | | |
|---|---|---|---|---|
| 3,457,568 | A | 7/1969 | Amatruda | |
| 4,043,354 | A * | 8/1977 | Brown | 137/247.33 |
| 6,014,780 | A | 1/2000 | Jurek et al. | |
| 6,581,220 | B2 * | 6/2003 | Yekutiely et al. | 4/661 |

FOREIGN PATENT DOCUMENTS

DE 90 01 997.6 U1 4/1990

* cited by examiner

*Primary Examiner* — Lori Baker
(74) *Attorney, Agent, or Firm* — Sughrue Mion, PLLC

(57) ABSTRACT

A shower drainage arrangement that has a vertically extending drain opening (13) for the shower water which is to be channelled away. Arranged downstream of the drain opening (13) is a stench trap (14), which can be connected to a disposal line (19). The drainage arrangement (13) has an inflow housing (12) which can be installed in a vertical wall (8, 4) and which forms a chamber (18) which is arranged downstream of the drain opening (13) and is intended to allow inspection of the stench trap (14). A covering (11) is preferably positioned on the front of the inflow housing (12), and this covering can be removed to allow inspection of the stench trap (14). The invention allows straightforward production of a shower with a drain opening (13) arranged in a wall.

23 Claims, 3 Drawing Sheets

FLOOR DRAIN AND SANITARY INSTALLATION WITH SUCH A FLOOR DRAIN, AND METHOD OF FITTING SUCH A SANITARY INSTALLATION

The invention relates to a floor drain according to the preamble of claim 1. The use of floor drains of this type in buildings has been known for some time now. These drains are used, for example in a shower or in a kitchen, to channel away floor-level water into a disposal line running in the floor. Upstream of the disposal line, the floor-level water passes into a drain cup, in which a stench trap is arranged.

A floor drain for a shower is disclosed, for example, in the applicant's EP-A-1 775 395. This floor drain has a drain cup which can be fitted beneath an opening of a shower tray and, above an inflow opening, has a cover which can be removed in order for the drain cup to be cleaned.

A further floor drain of the type mentioned has been disclosed in GB-A-2 315 211 of the prior art. A shower tray is provided in this case as well. The drain opening is arranged in a periphery of the shower tray and is connected, via an angled pipe, to a stench trap arranged alongside the shower area. In order for the stench trap to be cleaned, the latter has a removable cover.

There is an increasing desire for showers which do not have a shower tray. In the case of these showers, the stench trap is usually accommodated in an opening in the floor, in which case the horizontally extending drain opening is flush with the top side of the floor. Such showers have the advantage that they can be used more easily by the disabled, the weak and the elderly.

The object of the invention is to provide a floor drain of the type mentioned which is suitable, in particular, for showers without a shower tray, but also for other types of sanitary installations.

The object is achieved according to claim 1. The invention makes it possible for floor-level water to be channeled away through an opening in a vertical wall, for example in a shower or in a kitchen.

The floor drain according to the invention can be installed, in its entirety, in a wall, for example in a false wall or structural wall. The shower area may thus be designed as desired, irrespective of the drain. Since the shower area does not require any drain cover, or any shower tray, it may be configured in a manner which is particularly appropriate for the disabled. The drainage arrangement is also advantageous from an aesthetic and/or architectural viewpoint since the drain opening may be configured to be very unobtrusive. In may be configured, for example, as a comparatively narrow slot at the bottom end of a wall. The water can then drain very effectively from the floor into this slot, or into this drain opening. The floor here is preferably inclined in the direction of the drain opening. The drain according to the invention, however, is also suitable, for example, for draining floor-level water in a kitchen or in any other room or area in which floor-level water has to be channeled away.

A development of the invention provides an inflow housing with a covering which can be removed for cleaning or inspection purposes. The covering is, for example, a plate which is arranged above the drain opening. It may be, for example, latched on. It may be produced, for example, from a metal or some other material, for example stone or wood. This covering is preferably likewise essentially flush with a front side of the vertical wall. Once the covering has been removed, the drain cup is readily accessible for inspection or cleaning purposes. For example, it would be possible for a dip vessel or a dip tube of the drain cup to be removed and for the housing to be cleaned. Following inspection or cleaning, all that is required is for the covering to be placed in position again, for example latched on.

According to a development of the invention, the inflow housing and the drain cup form a unit. This allows particularly straightforward fitting. For example, this unit may be installed as an installation unit in a false wall. Particularly straightforward, quick and reliable fitting is achieved if the unit forms a pre-assembled unit with the false wall.

A development of the invention provides that the inflow housing is arranged directly above the drain cup. This allows a particularly space-saving arrangement. This is then suitable, in particular, for a shower which is arranged in a corner of a room. A particularly straightforward and space-saving construction is achieved when, according to a development of the invention, the inflow housing is designed in the form of an enclosure and has a front opening which forms the above-mentioned vertical drain opening. The enclosure-like inflow housing is suitable, in particular, for installation in a false wall.

According to a development of the invention, the wall-drain opening is a horizontally and vertically extending slot. The slot is arranged, in particular, flush in a wall and may be particularly unobtrusive and, nevertheless, configured such that the shower water can flow out quickly. The floor drain is, or can be, installed preferably in a vertical wall. The wall may be a structural wall or a false wall. In the case of a structural wall, the arrangement is inserted into a corresponding opening in the structural wall. The false wall itself may be any desired false wall and may be produced, for example, as a framework of vertical and horizontal profiles. It may also be provided for a shower which has at least one fitting for operating a shower head.

The invention also relates to a sanitary installation with a floor drain according to the invention. In the case of this installation, the floor drain is installed in an opening in the vertical wall. The wall-drain opening here is preferably essentially flush with a front side of this vertical wall.

According to a development, the installation is a shower which has a shower area formed by a floor superstructure with a top side. The inflow housing is located essentially above the plane of this top side, and the drain cup is located beneath this plane. The drain cup is preferably set down on a floor substructure and has a height corresponding essentially to the height of the floor superstructure. This makes it possible, in particular, for the disposal line to be laid in the floor superstructure. The shower water therefore then passes essentially horizontally from the top side of the shower area, through the drain opening to the stench trap, then flows vertically downwards into the stench trap and, from there, flows essentially horizontally again into the disposal line.

According to a development of the invention, the sanitary installation has a false wall which forms a prefabricated installation unit with the floor drain. When the false wall is fitted, the floor drain is thus also fitted at the same time.

The invention additionally relates to a method of fitting a sanitary installation. In a first step of this method, the drain cup is arranged on a floor substructure and connected to a disposal line. A floor superstructure is then produced on the floor substructure, the floor superstructure having a top side which is essentially flush with the top side of the stench trap.

Fitting can be carried out particularly quickly and reliably when use is made of a false wall in which the floor drain is integrated. It is then possible for the false wall to be fitted, together with the floor drain, on a floor substructure and for the floor substructure to be erected thereafter.

Further advantageous features can be gathered from the dependent patent claims, from the following description and from the drawing.

An exemplary embodiment of the invention will be explained in more detail hereinbelow with reference to the drawing, in which.

Figure 1:
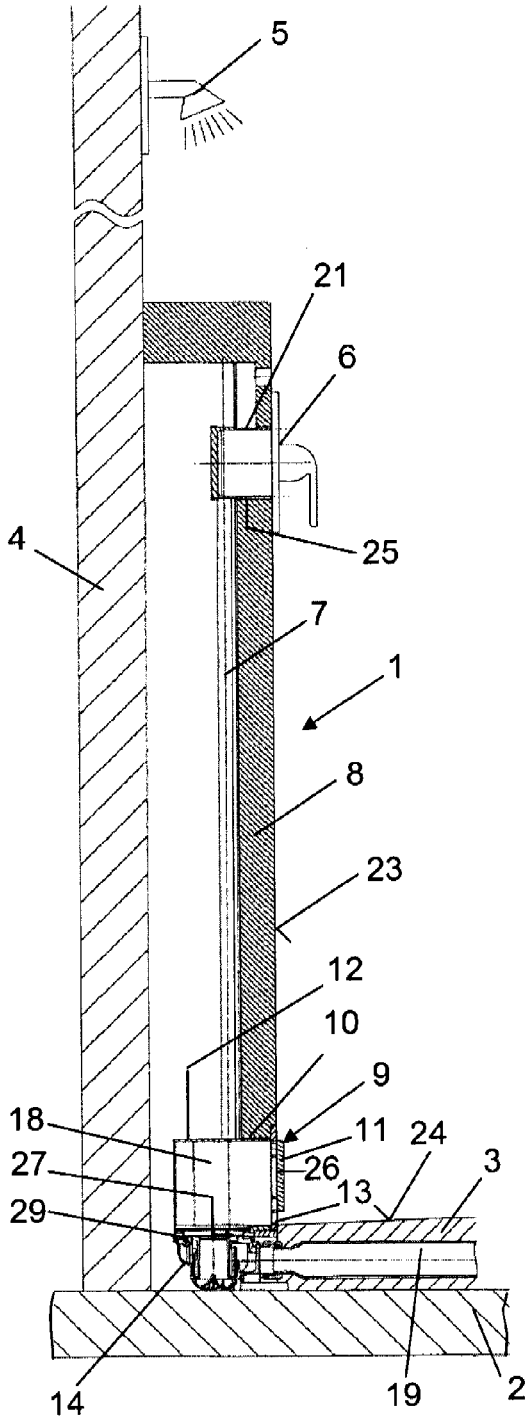
FIG. 1 shows, schematically, a vertical section through a shower with a drainage arrangement according to the invention.
Figure 2:
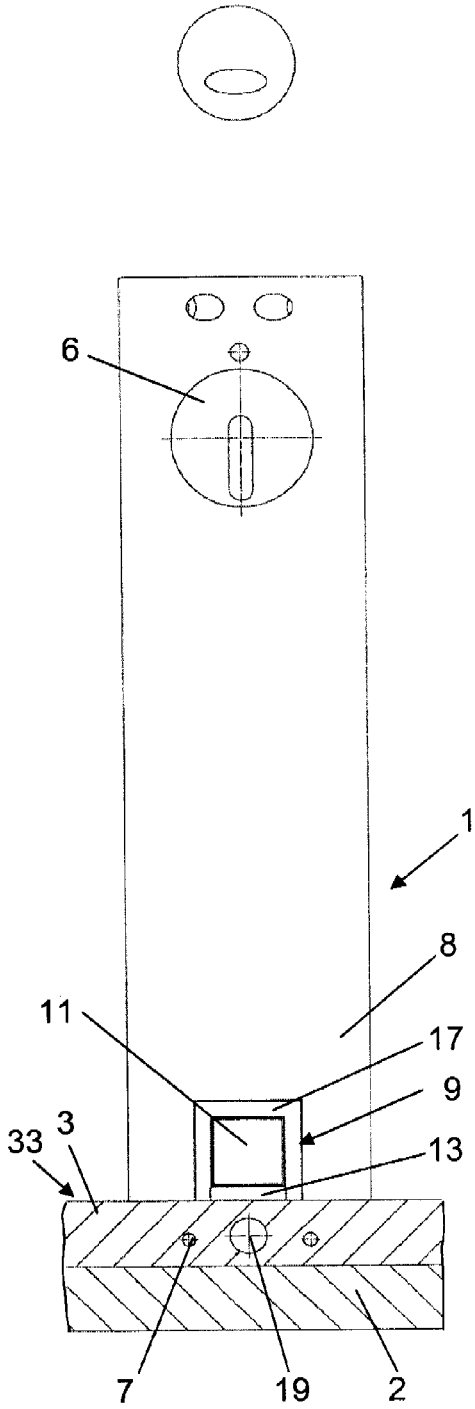
FIG. 2 shows a view of the shower according to FIG. 1.

The shower 1 which is shown in FIGS. 1 and 2 is arranged in a room which has a floor 33, with a floor substructure 2 and a floor superstructure 3, and a structural wall 4. The floor superstructure 3 may be a conventional prefabricated floor, and it has a top side 24 which is preferably inclined in the direction of a wall-drain opening 13. Running within the floor superstructure 3 is a disposal line 19, which is connected to a stench trap 14 of a drain cup 16 via an outflow connector 15 and through which shower water can be channelled away.

Figure 4:
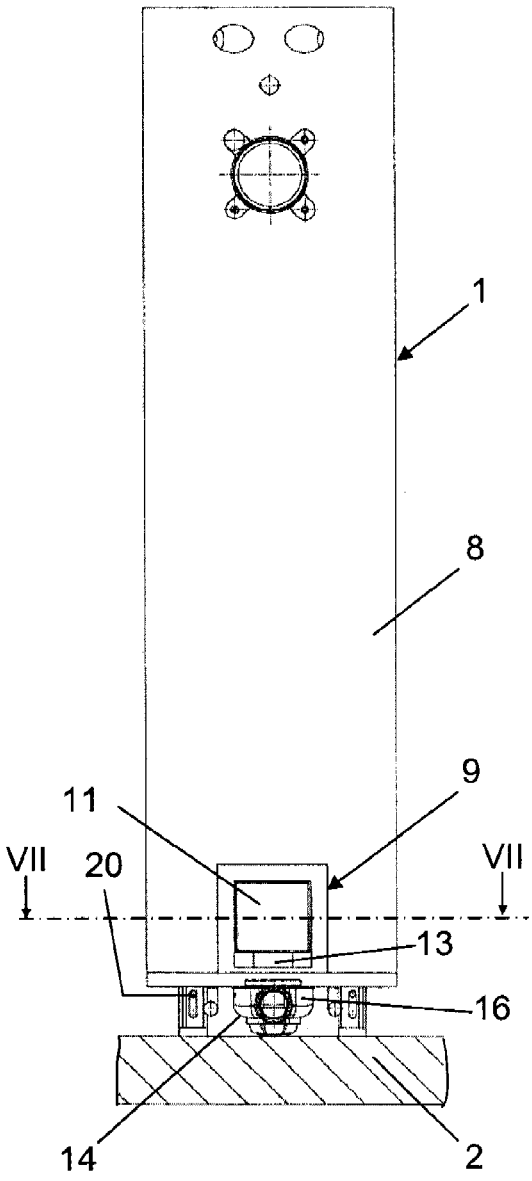
FIG. 4 shows a view of the arrangement according to FIG. 3.
Figure 5:
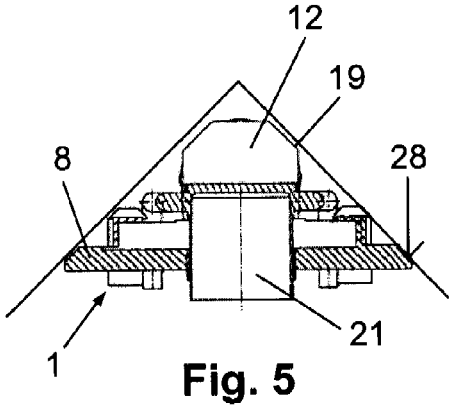
FIG. 5 shows a section along line V-V from FIG. 3.
Figure 6:
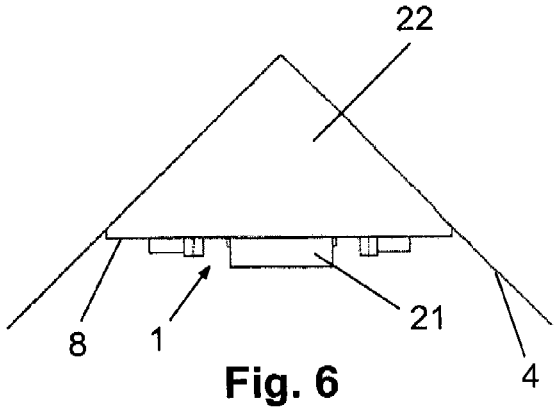
FIG. 6 shows a further view of the shower according to FIG. 1.

Arranged above the floor superstructure 3 is a false wall 8, which is positioned on the floor substructure 2 and is connected to the structual wall 4. According to FIG. 4, at least two spaced-apart pull-out feet 20 are arranged at the bottom end of the false wall 8. By way of these feet, the false wall 8 is set down on the floor substructure 2 and fastened thereon. Arranged on a rear side of the false wall 8 are supply lines 7, to which a shower fitting 6, or also other fittings, is/are connected and which routed downwards and, according to FIG. 2, into the floor superstructure 3, are connected to a supply system (not shown here). The fitting 6 is installed in an enclosure 221 which is inserted into an opening 25 in the false wall 8. The false wall 8 is, in particular, a shower wall which can be positioned parallel to a structural wall 4 or also in a corner of a room, as FIGS. 5 to 7 show.

The false wall 8, in a bottom region, has an opening 10 into which an inflow housing 12 is inserted. Arranged beneath the inflow housing 12, according to FIG. 1, is the drain cup 16, in which a stench trap 14 is located and which, along with the inflow housing 12, forms a floor drain 9 for the shower water. The inflow housing 12 is designed, for example, in the form of an enclosure having an opening 31 and a wall 32, and has a front vertically extending opening 26, which forms a vertically extending wall-drain opening 13 and is covered, at least in certain regions, by a covering 11. The covering 11 is enclosed by a frame 17, which is flush with a front side 23 of the false wall 8. The frame 17 may be designed as a periphery or flange of the inflow housing 12. The covering plate 11 may project to some extent in relation to this front side 23, as FIG. 7 shows. The inflow housing 12 collects the water which is to be channelled away, and directs it to the drain cup 16, as is indicated in FIG. 7 by arrows 34.

The covering plate 11 may be produced from any desired material, for example from plastic, metal, stone or wood. It can be fitted in a releasable manner, for example latched on or screwed on. Behind the covering 11, the housing 12 contains an interior chamber 18, which is located above the stench trap 14 and, with the covering 11 removed, allows the stench trap 14 to be inspected and cleaned.

Figure 7:
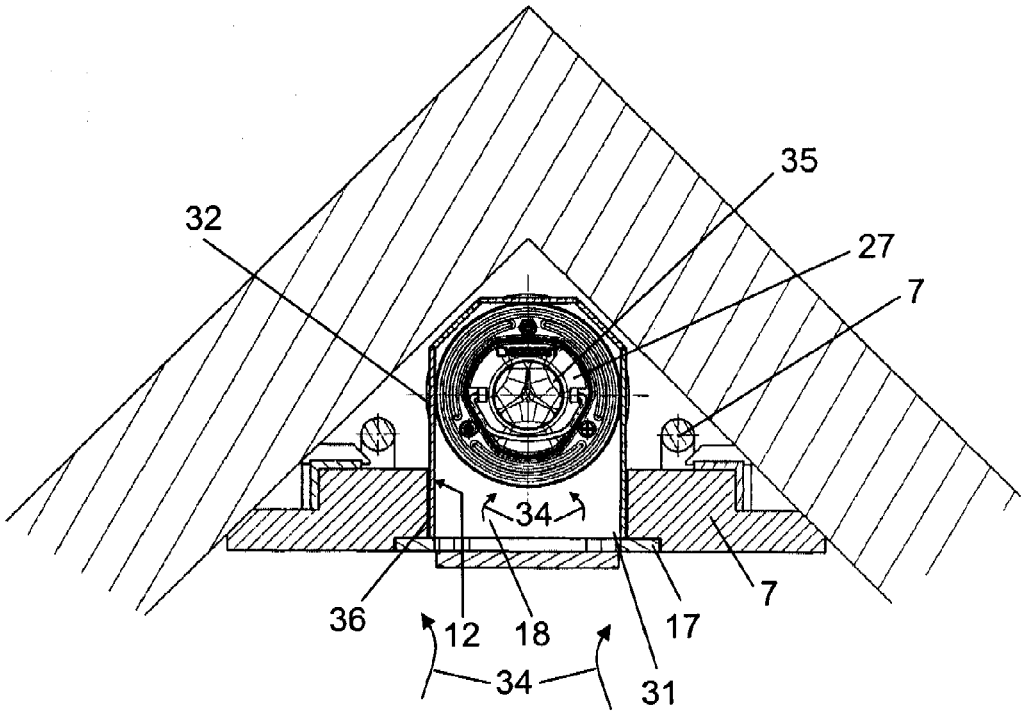
FIG. 7 shows a section along line VII-VII from FIG. 4.

The drain cup 16 has a top inflow opening 35, which is shown in FIG. 7 and into which a water-permeable cover 27 is inserted. With the covering 11 removed, the cover 27 can be removed and a dip tube, which is not shown here but is known per se, can be taken out for cleaning purposes. Following inspection and cleaning, the covering 11 is placed in position again, for example latched on or screwed on.

The inflow housing 12 is connected in a sealed manner to the drain cup 16. The connection contains, for example, a sealing collar 29 or some other suitable seal, which is arranged between the drain housing 12 and the drain cup 16 and ensures that shower water or other floor-level water which flows into the inflow housing 12 always leaves the latter by way of the stench trap 14. The inflow housing 12 and the drain cup 16 preferably form a unit. The inflow housing 12 may be integrally formed on the drain cup 16 or connected in a releasable manner, for example screwed or latched, to the same.

The connecting location between the inflow housing 12 and the drain cup 16 is located essentially in a plane which is formed by the top side 24 of the floor superstructure 3. The inflow housing 12 is thus located above this plane, and the drain cup 16 is located beneath this plane. The drain opening 13 extends vertically upwards, and also horizontally, from this plane, as FIG. 2 shows. It is designed as a slot and, in the view according to FIG. 2, is arranged approximately centrally in the false wall 8. The drain opening 13 is bounded laterally by the frame 17 and upwardly by the covering 11. As, in particular, FIG. 7 shows, the frame 17 seals the opening 10 in the false wall 8, in which case the floor-level water which is to be channeled away flows out into the inflow housing 12 exclusively in the direction of the arrows 34. A for example U-shaped and vertically extending wall 36 of the inflow housing 12 collects the floor-level water and directs it to the drain cup.

The floor drain 9 preferably forms an installation unit with the false wall 8. It is basically also possible, however, for the floor drain 9 to be fitted without the false wall 8. It may be inserted, for example, into an opening (not shown here) in the structural wall 4. However, fitting is simplified to a significant extent if the false wall 8 and the floor drain 9 form a pre-assembled unit. The floor drain 9 is preferably pre-fitted and can be fitted, with the false wall 8, as a unit at the site of installation.

Figure 3:
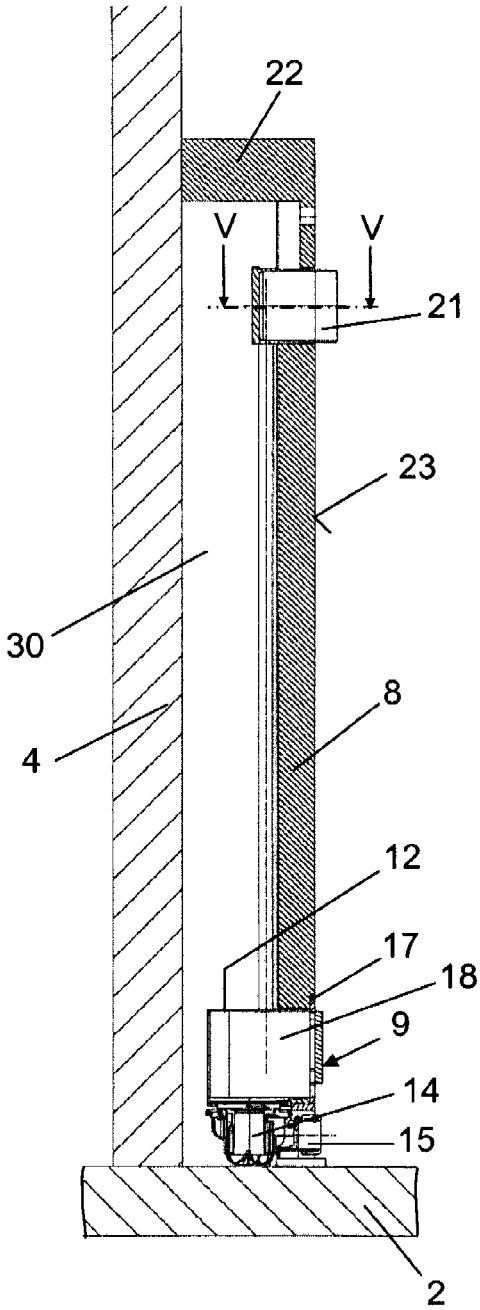
FIG. 3 shows a section through the shower according to FIG. 1, but without the floor superstructure or any fittings.

The operation of assembling the shower 1 will be explained hereinbelow, by way of example, with reference to FIGS. 3 to 7. The shower 1 can be assembled following completion of the floor substructure 2 and of the structural wall 4. In a first assembly step, the false wall 8, with the floor drain 9 pre-fitted, is set down on the floor substructure 2 by way of the feet 20, at a suitable spacing from the structural wall 4, and is adjusted to prefabricated-floor level, for example is fastened by way of fastening screws (not shown here). Fastening means (not shown here) are then used to fasten the false wall 8 on the structural wall 4. This results in the formation, between the false wall 8 and the structural wall 4, of a chamber 30, into which the floor drain 9 projects and in which the water lines 7 run. The top ends of these water lines project into the enclosure 21, which projects beyond the false wall 8 on the front side, as FIGS. 3 and 5 show. The chamber 30 is closed off at the top by a top wall 22 (FIG. 6). If the shower 1 is provided for fitting in a corner of a room, then this top wall 22, according to FIG. 6, is of a correspondingly triangular design. In addition, the false wall 8, according to FIG. 5, has, at the sides, correspondingly inclined surfaces 28, which can be positioned against the structural wall 4.

Once the false wall 8 has been fitted, the disposal line 19 is connected to a drainage connector 15 of the drain cup 16, the disposal line, of course, being inclined to some extent in relation to the horizontal. The floor superstructure 3 is then produced. The top side 24 here is designed such that it is inclined to some extent in relation to the wall-drain opening 13 and forms the bottom termination of the wall-drain opening 13. The floor superstructure 3 may be produced as desired. It can be cast, for example, from a suitable casting compound. However, it may also be produced, for example, from stone or wood.

Following completion of the floor superstructure 3, the enclosure 21 is cut to length, in which case it is flush at the front with the front side 23 of the false wall 8. The fitting 6 is then inserted into the enclosure 21 and connected to the lines 7. Finally, a cladding or tiles can be fitted on the front side of the false wall 8, and the covering 11 may be flush with said cladding or tiles. As a final step, according to FIGS. 1 and 2, a shower head 5 can be fitted above the false wall 8. This shower head is merely shown schematically here and is, of course, connected to the lines 7.

LIST OF DESIGNATIONS

| | |
|---|---|
| 1 | Shower |
| 2 | Floor substructure |
| 3 | Floor superstructure |
| 4 | Structural wall |
| 5 | Shower head |
| 6 | Shower fitting |
| 7 | Water line |
| 8 | False wall (shower wall) |
| 9 | Floor drain |
| 10 | Opening |
| 11 | Covering |
| 12 | Inflow housing |
| 13 | Wall-drain opening |
| 14 | Stench trap |
| 15 | Outflow connector |
| 16 | Drain cup |
| 17 | Frame |
| 18 | Interior chamber |
| 19 | Disposal line |
| 20 | Foot |
| 21 | Enclosure |
| 22 | Top wall |
| 23 | Front side |
| 24 | Top side |
| 25 | Opening |
| 26 | Opening |
| 27 | Cover |
| 28 | Surfaces |
| 29 | Seal |
| 30 | Chamber |
| 31 | Opening (inflow housing) |
| 32 | Wall (inflow housing) |
| 33 | Floor |
| 34 | Arrow |
| 35 | Inflow opening |
| 36 | Wall |

The invention claimed is:

1. A floor drain comprising:

a drain cup which has a top opening for floor-level water which is to be channelled away, an outflow which can be connected to a disposal line, and an inflow housing arranged above said opening of the drain cup and being open on one side and being connectable to a wall-drain opening in a vertical wall and operative to collect floor-level water which is to be channelled away, in which case the drain cup, when installed in said vertical wall, the floor-level water collects downstream of the wall-drain opening and is directed into the drain cup, wherein the inflow housing has a removable covering.

2. The floor drain according to claim 1, wherein the inflow housing has a wall with a lateral opening through which the floor-level water which is to be channelled away can flow into the inflow housing.

3. The floor drain according to claim 2, wherein the inflow housing and the drain cup form a unit.

4. The floor drain according to claim 2, wherein the inflow housing is arranged directly above the drain cup.

5. The floor drain according to claim 1, wherein the inflow housing is designed in the form of an enclosure.

6. The floor drain according to claims 1, wherein the wall-drain opening is a horizontally and vertically extending slot.

7. The floor drain according to claim 1, wherein a drain housing has a flange which can be positioned against the wall-drain opening and encloses said opening, in the form of a frame, at least in certain regions.

8. The floor drain according to claim 1, wherein it is provided for installation in a false wall or is pre-fitted in the false wall.

9. The floor drain according to claim 8, wherein the false wall is provided for a shower.

10. A floor drain comprising:

a drain cup which has a top opening for floor-level water which is to be channelled away, an outflow which can be connected to a disposal line, and an inflow housing arranged above said opening of the drain cup and being open on one side and being connectable to a wall-drain opening in a vertical wall and operative to collect floor-level water which is to be channelled away, in which case the drain cup, when installed in said vertical wall, the floor-level water collects downstream of the wall-drain opening and is directed into the drain cup, wherein the inflow housing has an interior chamber which is arranged above the drain cup and through which the drain cup can be inspected.

11. A sanitary installation with a floor drain as recited in claim 10 and having a floor and a vertical wall wherein the wall-drain opening extends vertically upwards from a top side of the floor, in which case floor-level water can flow directly into the inflow housing from the floor.

12. A sanitary installation according to claim 11, wherein a drain cup is set down on a floor substructure and extends essentially up to a top side of a floor superstructure.

13. Installation according to claim 11, wherein the top side of the floor forms a shower area, and in that floor-level water can flow directly into the wall-drain opening from this shower area.

14. Installation according to claim 11, wherein the vertical wall is a false wall which has the abovementioned wall-drain opening at a bottom end and in which the floor drain is installed.

15. Method of fitting an installation according to claim 11, wherein the drain cup is arranged on a floor substructure, and in that a floor superstructure is produced on the floor substructure, the floor superstructure having a top side which leads to the wall-drain opening.

16. Method according to claim 15, wherein the inflow housing and the drain cup are arranged as a unit on a floor substructure.

17. The floor drain according to claim 10, wherein the inflow housing and the drain cup form a unit.

18. The floor drain according to claim 10, wherein the inflow housing is arranged directly above the drain cup.

19. The floor drain according to claim 10, wherein the inflow housing is designed in the form of an enclosure.

20. The floor drain according to claims 10, wherein the wall-drain opening is a horizontally and vertically extending slot.

21. The floor drain according to claim 10, wherein a drain housing has a flange which can be positioned against the wall-drain opening and encloses said opening, in the form of a frame, at least in certain regions.

22. The floor drain according to claim 10, wherein it is provided for installation in a false wall or is pre-fitted in the false wall.

23. The floor drain according to claim 22, wherein the false wall is provided for a shower.

* * * * *